US008698627B2

(12) United States Patent
Londo et al.

(10) Patent No.: US 8,698,627 B2
(45) Date of Patent: Apr. 15, 2014

(54) SECURITY PACKAGING

(75) Inventors: Michael G. Londo, Midlothian, VA (US); Stephen L. Billups, Raleigh, NC (US); Caleb S. Loftin, Richmond, VA (US); Rune K. Haraldsson, Ashland, VA (US); William J. Knouse, Raleigh, NC (US)

(73) Assignee: MeadWestvaco Corporation, Richmond, VA (US)

( * ) Notice: Subject to any disclaimer, the term of this patent is extended or adjusted under 35 U.S.C. 154(b) by 292 days.

(21) Appl. No.: 12/975,635

(22) Filed: Dec. 22, 2010

(65) Prior Publication Data

US 2011/0210030 A1 Sep. 1, 2011

Related U.S. Application Data

(63) Continuation-in-part of application No. PCT/US2010/020169, filed on Jan. 6, 2010.

(60) Provisional application No. 61/143,112, filed on Jan. 7, 2009, provisional application No. 61/260,547, filed on Nov. 12, 2009, provisional application No. 61/348,594, filed on May 26, 2010.

(51) Int. Cl.

| | |
|---|---|
| ***G08B 13/14*** | (2006.01) |
| ***G08B 13/12*** | (2006.01) |
| ***G08B 23/00*** | (2006.01) |
| ***B65D 83/04*** | (2006.01) |
| ***G04B 47/00*** | (2006.01) |

(52) U.S. Cl.

USPC ..... 340/568.1; 340/568.2; 340/572.1; 340/693.5; 206/539; 368/10

(58) Field of Classification Search

None

See application file for complete search history.

(56) References Cited

U.S. PATENT DOCUMENTS

| | | | | |
|---|---|---|---|---|
| 4,660,991 | A * | 4/1987 | Simon | 368/10 |
| 4,711,368 | A | 12/1987 | Simons | |
| 5,217,307 | A * | 6/1993 | McClintock | 383/81 |
| 5,285,734 | A | 2/1994 | MacPherson | |
| 5,289,785 | A | 3/1994 | MacPherson et al. | |
| 5,406,263 | A | 4/1995 | Tuttle | |
| 5,464,092 | A | 11/1995 | Seeley | |
| 5,539,379 | A | 7/1996 | MacPherson | |
| 5,646,592 | A | 7/1997 | Tuttle | |
| 5,831,531 | A | 11/1998 | Tuttle | |

(Continued)

FOREIGN PATENT DOCUMENTS

| | | |
|---|---|---|
| DE | 202008006748 U1 | 8/2008 |
| EP | 1241647 A1 | 9/2002 |

(Continued)

OTHER PUBLICATIONS

International Search Report and Opinion for PCT/US10/020169 (International application of this case), ca May 28, 2010.

(Continued)

*Primary Examiner* — Julie Lieu

(74) *Attorney, Agent, or Firm* — MWV Intellectual Property Group

(57) ABSTRACT

A package comprises a security device where a security loop is formed integrally with the package for detecting a breach of the package. Additionally, the security loop may be formed with a portion to be interrupted if the contents are removed from the package.

18 Claims, 9 Drawing Sheets

(56) References Cited

U.S. PATENT DOCUMENTS

| | | | | |
|---|---|---|---|---|
| 6,888,461 | B2 | 5/2005 | Houde | |
| 6,973,371 | B1 * | 12/2005 | Benouali | 700/244 |
| 7,049,962 | B2 | 5/2006 | Atherton et al. | |
| 7,098,794 | B2 | 8/2006 | Lindsay et al. | |
| 7,102,519 | B2 | 9/2006 | Lyon et al. | |
| 7,113,101 | B2 * | 9/2006 | Petersen et al. | 340/590 |
| 7,116,227 | B2 | 10/2006 | Eckstein et al. | |
| 7,119,684 | B2 | 10/2006 | Petersen et al. | |
| 7,126,879 | B2 * | 10/2006 | Snyder | 368/10 |
| 7,170,409 | B2 * | 1/2007 | Ehrensvard et al. | 340/539.26 |
| 7,274,289 | B2 | 9/2007 | Kerr et al. | |
| 7,301,460 | B2 | 11/2007 | Coste | |
| 7,368,033 | B2 | 5/2008 | Eckstein et al. | |
| 7,382,262 | B2 | 6/2008 | Commagnac et al. | |
| 7,384,496 | B2 | 6/2008 | Cote et al. | |
| 7,460,015 | B2 | 12/2008 | Forster et al. | |
| 7,482,924 | B1 | 1/2009 | Beinhocker | |
| 7,504,951 | B2 | 3/2009 | Phipps et al. | |
| 7,552,824 | B2 | 6/2009 | Le et al. | |
| 7,564,354 | B2 | 7/2009 | Eren et al. | |
| 7,573,390 | B2 | 8/2009 | Nagao et al. | |
| 7,812,726 | B2 | 10/2010 | Barlow et al. | |
| 7,856,708 | B2 | 12/2010 | Eckstein et al. | |
| RE42,777 | E | 10/2011 | Tuttle | |
| 8,035,524 | B2 | 10/2011 | Sakama et al. | |
| 8,087,269 | B2 * | 1/2012 | Conti et al. | 70/14 |
| RE43,415 | E | 5/2012 | Tuttle | |
| 2001/0028308 | A1 * | 10/2001 | De La Huerga | 340/573.1 |
| 2002/0017996 | A1 * | 2/2002 | Niemiec | 340/573.1 |
| 2002/0047107 | A1 | 4/2002 | Lindstrom et al. | |
| 2002/0067264 | A1 | 6/2002 | Soehnlen | |
| 2003/0099158 | A1 * | 5/2003 | De la Huerga | 368/10 |
| 2004/0178112 | A1 * | 9/2004 | Snyder | 206/534 |
| 2005/0127157 | A1 | 6/2005 | Stemmle et al. | |
| 2005/0151067 | A1 | 7/2005 | Beinhocker | |
| 2005/0162979 | A1 * | 7/2005 | Ostergaard et al. | 368/10 |
| 2005/0241983 | A1 * | 11/2005 | Snyder et al. | 206/539 |
| 2006/0202830 | A1 * | 9/2006 | Scharfeld et al. | 340/572.7 |
| 2006/0260493 | A1 | 11/2006 | Travis et al. | |
| 2008/0001741 | A1 | 1/2008 | Cobianu et al. | |
| 2008/0053222 | A1 | 3/2008 | Ehrensvard et al. | |
| 2009/0184023 | A1 * | 7/2009 | Brollier et al. | 206/531 |
| 2012/0092181 | A1 | 4/2012 | Daniel et al. | |

FOREIGN PATENT DOCUMENTS

| | | | |
|---|---|---|---|
| FR | 2714659 | A1 | 7/1995 |
| FR | 2783952 | A1 | 3/2000 |
| WO | WO2004037660 | A1 | 5/2004 |
| WO | WO2007090936 | A1 | 8/2007 |
| WO | WO2008067972 | A1 | 6/2008 |
| WO | WO2008103870 | A1 | 8/2008 |
| WO | WO2010080770 | A1 | 7/2010 |

OTHER PUBLICATIONS

International Search Report and Opinion for PCT/US12/056238 (International application of 22096-WOORD), ca Apr. 5, 2013.

International Search Report and Opinion for PCT/US13/028884 (International application of 22101-WOORD), ca Jul. 4, 2013.

* cited by examiner

SECURITY PACKAGING

CROSS-REFERENCE TO RELATED APPLICATIONS

This application is a continuation-in-part of International Application PCT/US10/020,169, entitled "SECURITY PACKAGING," filed Jan. 6, 2010, which claims the benefit of U.S. Provisional Application 61/143,112, filed Jan. 7, 2009 and U.S. Provisional Application 61/260,547, filed Nov. 12, 2009, and claims the benefit of, and incorporates herein by reference in their entirety, each of those applications; this application also claims the benefit of U.S. Provisional Application 61/348,594, filed May 26, 2010, and incorporates the same herein by reference in its entirety.

FIELD OF THE INVENTION

The invention relates to a security mechanism for a package, a package including such a security mechanism and/or a component of such a security mechanism and a method of making the package and the security mechanism. More specifically, but not exclusively, the invention relates to a security device where at least one security loop is formed integrally with the package for detecting a breach of the complete package. Additionally, the security loop may be formed with a portion that will be interrupted if the contents are removed from the package.

BACKGROUND OF THE INVENTION

In the field of packaging it is often required to maximise the display of premium (high-cost) articles for marketing and advertising purposes in retail outlets, yet at the same time it is necessary to secure those premium articles against theft or damage. Electronic article surveillance (EAS) is one known method for preventing shoplifting from retail stores. Special tags are fixed to merchandise and these tags are usually removed or deactivated at a pay counter once the article has been purchased. At the exits of the store, a detection system sounds an alarm if the security device has not been removed or deactivated and an attempt is made to remove the article from the retail outlet without paying.

In another method of theft prevention, wired alarm clips may also be used. These wired clips are wound around the exterior of an article or package. However, these known methods of securing against theft can be bulky and can obscure the product from display and/or may be vulnerable if the security tag or wired alarm is only affixed to the packaging containing the article and not the article itself. In such arrangements, by removing the article from the packaging and hence security tag, it may be possible to then take the article from the store without detection. Additionally, since it is not always possible to affix a security device directly to an article, for example, in the case of delicate or fragile articles, an alternative solution is required.

One such solution is offered by the Natralock® packaging, a product made by the present applicant, which utilises a tear-resistant polymer laminated recyclable paperboard combined with an APET or RPET thermoform to create a visible package nearly impossible to tear apart by hand which deters theft in stores. Whilst, the package can be opened easily and safely with household scissors, the requirement for use of scissors introduces a difficulty to the consumer. Furthermore, this package still requires an external security module to secure against theft of the entire package.

The present invention seeks to mitigate or overcome these and other problems associated with known security devices and/or provide an improvement over known security devices.

SUMMARY OF INVENTION

According to a first aspect, the invention provides a package containing a primary article and comprising a security feature having first and second parts which together are capable of detecting when the package is opened and in response to that detected opening issues an electrical signal, which electrical signal causes an alert to be issued. Preferably, the alert is an audible alarm emitted directly by the security feature.

According to a second aspect, the invention provides a package containing a primary article and having a first part of a security feature incorporated therein, the first part of the security feature being connectable to a second part of a security feature such that together, the first and second parts of the security feature are capable of detecting when the package is opened and capable of issuing an electrical signal in response to that detected opening which electrical signal is operable to cause an alert to be issued.

Preferably, the first part of the security feature is a security loop incorporated within the package and disposed relative to the article such that removal of the article from the package is likely to cause interruption of said security loop, said security loop being connectable to a second part of the security feature for detecting an interruption in said security loop and operable to react to such a detected interruption by issuing an alert.

According to an optional feature of the above aspect, the security loop is formed as an integral part of the package and comprises two terminals, each connectable to the second part of the security feature and said second part of the security feature is operable to issue an alert by sounding an alarm and/or by illuminating a light and/or by transmitting an electromagnetic signal. Preferably, the security loop is formed as an integral part of the package, is electrically conductive and is formed from conductive printed ink, conductive ribbon, conductive foil and/or conductive wire.

According to a preferable feature of the first and second aspects of the invention, the security feature detects opening of the carton by detecting a change in resistance of an electric circuit of said security feature. Preferably, the first part of the security feature is a security loop incorporated within the package and wherein the change in resistance is an increase in resistance and is due to one or more of the following: an interruption in the package integrity, an interruption in the security loop or the breaking of the security loop.

The second part of the security feature is either integrally formed within the package or is formed as a separate module that is connectable to and removable from the package.

Optionally, the second part is formed as a separate module that is removable from the package and the package further comprises an integral retaining means for retaining and releasing the module.

According to a third aspect, the invention provides a security module for use in a package according to any of the preceding paragraphs, which comprises a second part of a security feature and is connectable to a first part of a security feature disposed within the package.

Preferably, the first part of the security feature is a security loop incorporated within the package and second part of a security feature is capable of detecting an interruption in said security loop and capable of reacting to such a detected interruption by issuing an alert.

According to a further aspect the invention provides a blank for forming a package, the blank comprising an integrally formed security loop having terminals for coupling to a security module and/or comprising parts of a security loop, which parts are connected together to form a security loop having terminals for coupling to a security module once said blank is formed into a carton or package.

According to a further aspect the invention provides for a security loop incorporated within the package to be interrupted if package contents are removed from the package. The contents may be secured to a portion of the security loop by tape or glue whereby removing the contents breaks the tape and/or the loop, and breaks the circuit.

Optionally, the blank comprising integral means for retaining a security module, said integral means comprising one or more engaging tabs and being structured such that said security module is connectable to said terminals of the security loop.

Optionally, in any of the aspects, the security loop may be formed with a portion associated with the contents of the package, such that removing the contents from the package, or detaching the contents from the package, breaks the security loop.

Optionally, the security module may provide a hang hole, or be associated with an existing hang hole on the package.

Optionally, in certain of the aspects, the security module may cover or obscure an easy-open feature such as a nick or tear in the package, by which the package can be opened after removal of the security module.

A further aspect of the invention provides a kit of parts for forming a package having an integral security feature, the kit of parts comprising one or more blanks for forming the package, at least one of said blanks having a first part of a security feature incorporated therein; one or more articles to be contained in the package; and a second part of the security feature comprising an electronic circuit capable of connecting to the first part of the security feature and capable of detecting a breach of the package integrity and in response to that detected breach issues an electrical signal, which electrical signal causes an alert to be issued.

BRIEF DESCRIPTION OF THE DRAWINGS

Exemplary embodiments of the invention will now be described with reference to the accompanying drawings, in which.

DETAILED DESCRIPTION OF PREFERRED EMBODIMENT

Figure 5:
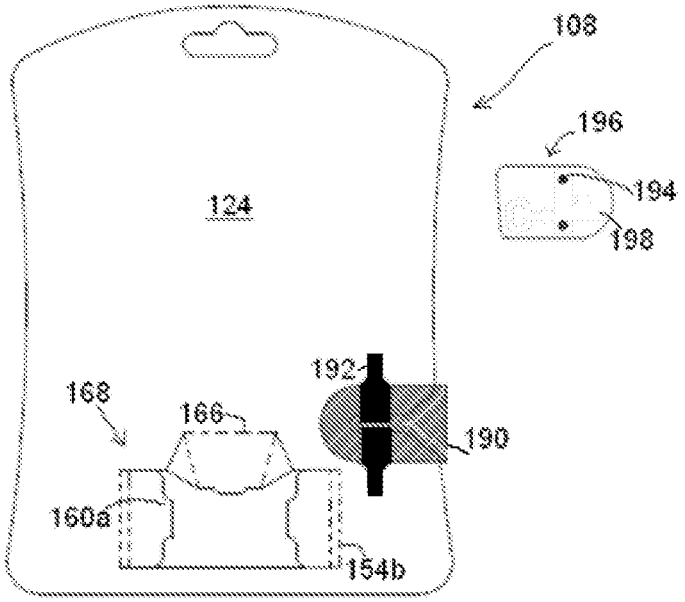
FIG. 5 shows a plan view of a second part blank for forming a package according to a second embodiment of the invention along with a key according to a second embodiment of the invention.
Figure 6:
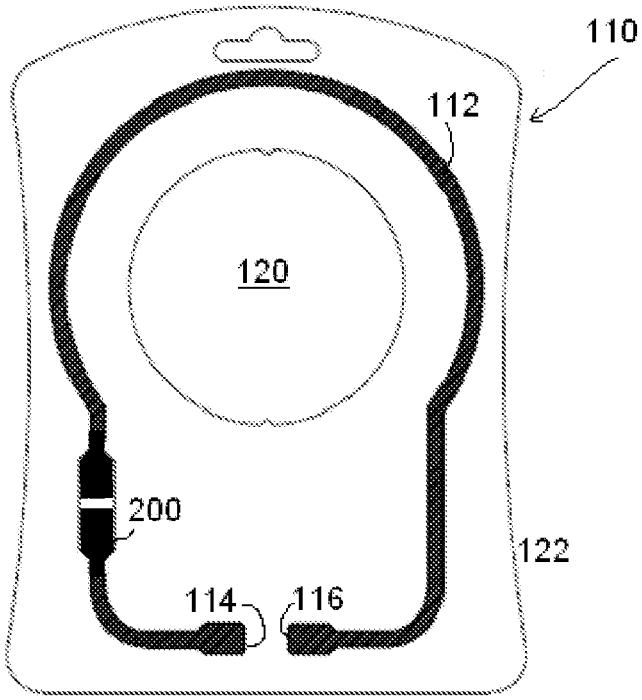
FIG. 6 shows a plan view of a first part blank for forming a package according to a second embodiment of the invention.
Figure 7:
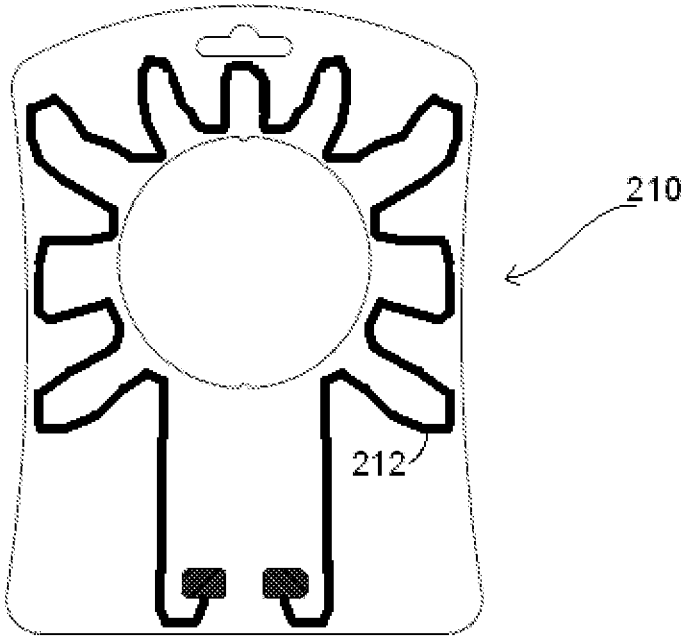
FIG. 7 shows a plan view of a first part blank for forming a package according to a third embodiment of the invention.

A first embodiment of the invention is depicted in FIGS. 1 to 4. A second embodiment is depicted in FIGS. 5 and 6, a third embodiment in FIG. 7, a fourth embodiment in FIG. 8, a fifth embodiment in FIG. 9, and a sixth embodiment in FIG. 10. Further embodiments will be described herein. It will be understood that the foregoing description and accompanying drawings are representative of non-limiting examples of how the present invention can be implemented.

Figure 1:
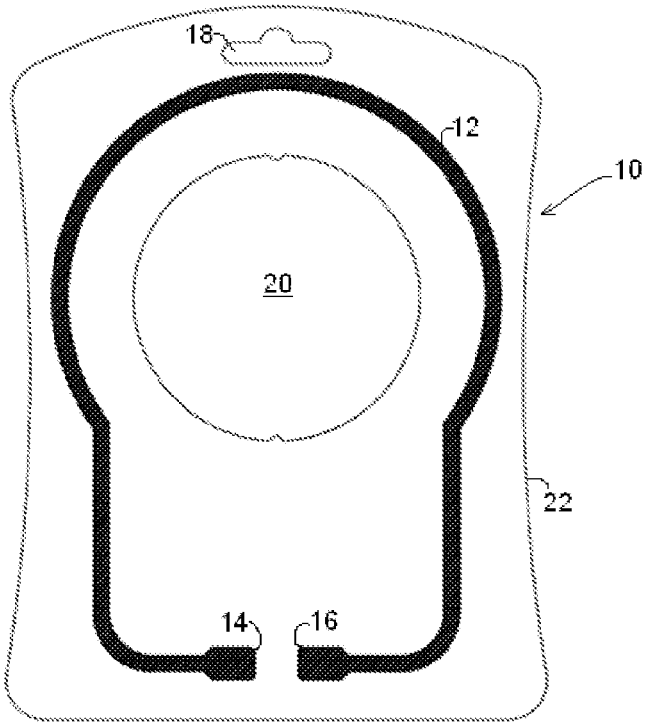
FIG. 1 shows a plan view of a first part blank for forming a package according to a first embodiment of the invention.
Figure 2:
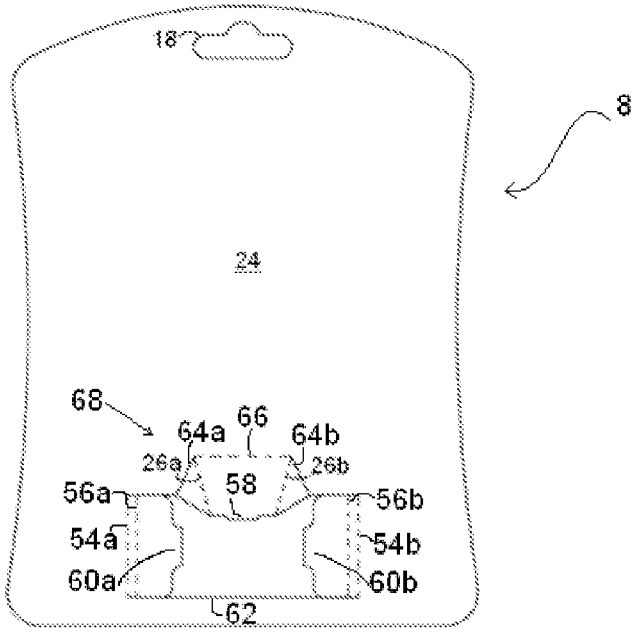
FIG. 2 shows a plan view of a second part blank for forming a package according to a first embodiment of the invention.

In FIG. 1 there is shown a first part blank 10 for forming a package having an at least partially integral security mechanism. The first part blank 10 is formed of paperboard; other suitable sheet material in alternative embodiments is used, for example: paper, cardboard, plastics material, coated paperboard and polymer laminated paperboard (such as Natralock®). In FIG. 2, there is shown a second part blank 8 formed of paperboard. Other suitable sheet material in alternative embodiments is used, for example: paper, cardboard, plastics material, coated paperboard and polymer laminated paperboard (such as Natralock®).

The first part blank 10 forms a front part of a composite package (not shown) formed by sandwiching a blister (for example an APET or RPET thermoform) between the first part blank 10 of FIG. 1 and the second part blank 8 of FIG. 2. Such composite packages are known in the art and provide a cost effective and environmentally conscious packaging solution that provides for secure and protective packaging and display of an article held within the blister (and secured by the first and second blanks 10, 8). The invention is illustrated with reference to such a package, however, it will be understood that the invention has application to other types of packaging where it is required to integrate security features into a package in order to provide an alerting signal in the event the package is tampered with. Such alternative package constructions include: CD tray form, carton form, medical slide tray form and any other desired package shape or size.

Figure 3:
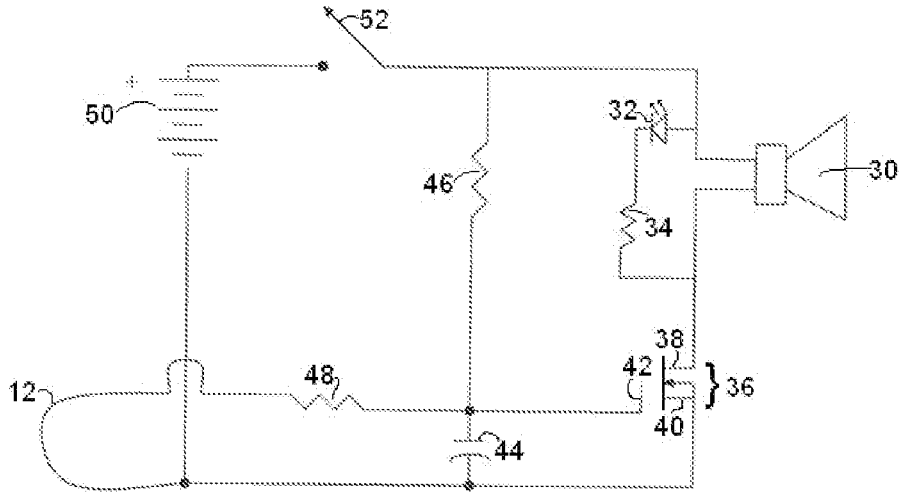
FIG. 3 is a schematic illustration of an electric circuit comprised in a security module according to a first embodiment of the invention.
Figure 4:
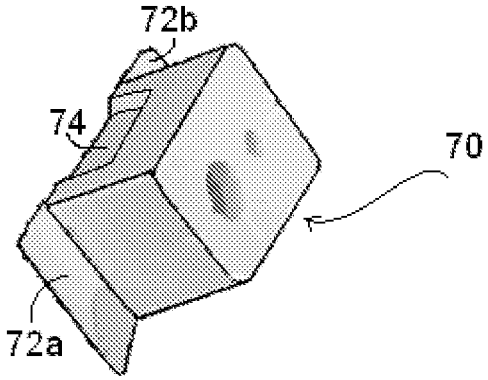
FIG. 4 is a perspective view of a security module according to a first embodiment of the invention.

The package of the present invention also includes a security module 70, as shown in FIG. 4 which is held on the second part blank 8. The security module 70 includes an electronic circuit, as shown in FIG. 3.

The first part blank 10 is defined by an edge 22 and includes an aperture 20 through which a blister (not shown) can protrude; a security loop 12 and first and second contacts 14, 16. A hanging aperture 18 is also provided merely for facilitating hanging display or hanging storage of the package. This hanging aperture feature 18 is entirely optional. Aperture 20 is an optional feature which would not be present when the invention is applied to other formats of package not including a blister. The security loop 12 is formed of conductive ink that is printed onto the paperboard panel 10. In alternative embodiments, the security loop is printed onto the blister itself or the blister and the panel 10. A stamping technique can be used to print onto the blister, but there is a greater cost associated with printing on plastic compared to paperboard like materials.

The security loop 12 is printed such that it at least partially surrounds the article to be held within the blister to be disposed within the aperture 20. The specific path or shape of the security loop will alter according to various considerations for example: the nature of the package to which the invention is applied; the configuration (i.e. shape) of article(s) held by the package and the number and orientation of articles contained within the package. It is required that the security loop 12 is arranged in such a manner that in order to gain access to an article held within the package, interruption or complete breaking of the security loop 12 is necessary or at least highly likely. The more likely it is that the security loop 12 will be interrupted or broken when the package is tampered with in order to remove an article, the more effective the security feature of the package will be. The security loop 12 is coupled to an external security module (see FIG. 4) that includes electronic circuitry (see FIG. 3) configured such that a detected interruption in the security loop 12 will cause an alert to be issued.

Using conductive ink is beneficial because the security loop 12 can be easily printed onto the inside face of panel 10. This ink may be printed onto the board using regular printing press methods. In the specific embodiment described, the conductive ink used has a temperature and/or pressure sensitivity. Preferably, during the printing stage the temperature of the ink should not exceed 70° C. (degrees Celsius) or 160° F. (degrees Fahrenheit). The ink should be allowed to dry. It may take up to five minutes or up to ten minutes or longer depending upon conditions for the conductive ink to fully set. After the conductive ink is printed and set then the panel 10 is further processed and graphic printing takes place. During the graphics printing process and subsequent package forming process, the temperature and pressure sensitivity of the conductive ink must be considered. It is to be understood that a variety of tools may be used to apply the graphics to the package and that each set of tools may effect the appropriate pressure and temperature ranges that may be applied without disrupting the functionality of the conductive ink. A pressure of up to 20 psi may be used and a temperature up to 400° F. may be used to seal the package. Other ranges for pressure and temperatures may also work to seal and print the graphics without damaging the ink's conductive properties depending upon the conditions, equipment and materials used. Damage or change in the conductive properties of the conductive ink material could cause the security feature to fail. The pressure and temperature limits may vary based on the materials used. Development of conductive inks may alter these temperature and pressure considerations. It is to also be understood that the exact order of these sequences may be adjusted depending upon manufacturing preferences. For example, the graphics could be printed on the external package prior to the conductive ink being printed on the package.

The conductive ink used for printing the security loop of the present embodiment may be replaced with other suitable means for allowing an interruption of that loop to be conveyed to an alert means. Other electrically conductive materials readily could be used in replacement of or in combination with the conductive ink, for example: foil ribbon, wire and conductive plastics or polymer material. In the present example, a conductive material is used so that a break or interruption in the security loop 12 causes an increased resistance within an electronic circuit to which the security loop 12 is coupled which results in an alarm sounding. This mechanism is described in further detail below with reference to FIG. 3. The security loop 12 may be formed from material that can readily be torn through so that the presence of a security loop incorporated within the package does not hinder a consumer gaining access to their article once the product has been purchased. It is to be understood that the module connected to the security loop may also be designed to interact with other anti-theft devices in a store. For example it could also be designed to sound if the entire package is removed from the building (e.g. when the package crosses security detection devices placed at the doors).

The second part blank 8 for forming the back panel of the package of this example is shown in FIG. 2. The second part blank 8 includes a single panel 24; a similarly shaped and formed optional hanging aperture 18 and a security module retaining feature 68. The security module retaining feature 68 includes a series of shaped cuts and fold lines. Fold lines are depicted in the illustration in FIG. 2 by dashed lines. The security module retaining feature 68 includes a top engaging portion which includes fold lines 66, 64*a*, 64*b*, 26*a*, 26*b* and tab 58. A triangular portion is defined by the fold lines 26*a*/64*a* and a lower edge of the top engaging portion. A further the triangular portion is defined by the fold lines 26*b*/64*b* and a lower edge of the top engaging portion. The upper engaging portion can be hinged as a unit about fold line 66. The triangular portions and tab 58 create an engaging structure that retains the security module within the package.

The retaining feature 68 also includes two side engaging portions which each includes a pair of fold lines 56*a*, 54*a* and 56*b*, 54*b* respectively and a tab 60*a* and 60*b* respectively. Cutline 62 defines a lower edge of the security module retaining feature 68. The aforementioned fold lines, cut lines and tabs are shaped and arranged to receive and securely retain a module 70 (see FIG. 4) including the electronic circuitry of the invention (see FIG. 3). An example of the shape and format of the security module 70 that houses the electronic circuitry is shown in FIG. 4. The module 70 has an upper recess 74 and side portions 72*a*, 72*b*.

The security module 70 is loaded into the package by first lifting up tab 58 and adjacent triangular portions to thereby define an upper opening. The module 70 can then be aligned with, and by using a sliding action, loaded into that upper opening such that side portions 72*a*, 72*b* of the security module 70, each slide behind the adjacent tab 60*a*, 60*b*. Once the module 70 has been slipped between the front 10 and back panel 8 of the package, each of the tabs 58, 60*a*, and 60*b* can be manipulated into engagement with a corresponding recess 74 of the security module 70 to thereby secure that module 70 onto and within the package. The module 70 includes two electrical contacts that couple to the terminals 14, 16 of the security loop 12, this contact is maintained by the engagement of the tabs 58, 60*a*, 60*b* holding the module 70 in place.

The security module 70 is arranged such that the start contact 14 and terminal contact 16 of the security loop make an electrical contact with the circuit held within the module 70. Turning now to the exemplary circuit, reference is made to FIG. 3. Standard symbols have been used to denote the various components of the circuit, these have each been numbered and the following table lists the various components by number.

TABLE 1

| Key to reference numerals used in circuit diagram of FIG. 3 | |
|---|---|
| 30 | Alarm |
| 32 | LED (2 V red light emitting Diode) |
| 34 | First resistor (330 Ω) |

TABLE 1-continued

| Key to reference numerals used in circuit diagram of FIG. 3 | |
|---|---|
| 36 | Field-Effect Transistor (FET) (product code: 2N7000) |
| 38 | FET Drain |
| 40 | FET Source |
| 42 | FET Gate |
| 44 | Capacitor (0.1 μF) |
| 12 | Security loop |
| 46 | Second Resistor (4.7MΩ) |
| 48 | Third Resistor (1001 kΩ) |
| 50 | 3 to 6 V DC power supply (battery) |
| 52 | Switch |

The circuit includes two parts, the first part includes a power supply 50 coupled to an optional switch 52, coupled to a second resistor 46 (in this example, the second resistor is 4.7 MΩ) coupled via a third 100 kΩ resistor to the security loop 12, which is coupled at its other end to the negative of the power supply. The second part of the circuit includes a transistor (FET) 36, light 32 (red LED) and an alarm 30. The switch 52, if present, is closed to turn the circuit on.

The first and second parts of the circuit are therefore in parallel with one another and the voltage across the first part is divided across the second 46 and third 48 resistors. In normal operation the third resistor 48 is relatively small compared to the second, and the gate 42 of the FET is effectively grounded, via the security loop 12 to the negative terminal of the power supply 50. Thus, the FET is held in a non-conducting state and current is prevented from flowing through the second part of the circuit containing the alarm 30.

When the security loop 12 is broken or interrupted or affected in any way, the resistance of the security loop 12 increases and the voltage at the gate of the FET consequently rises as a result of the potential division taking place in the first part of the circuit. The ratio between the combined resistance of the security loop 12 and the third resistor 48 in comparison to the resistance of the second resistor 46 dictates the percentage of the power supply's potential that is present at the gate of the FET 42.

If the resistance in the security loop 12 is increased sufficiently to cause the voltage at the gate of the FET to reach the threshold "switch on voltage" for the FET to conduct, then the FET will permit current to flow through the second part of the circuit, including the LED 32 and alarm 30. Thus the LED 32 and the alarm 30 will be operated.

The security module 70 includes all components of the afore described circuit, with the exception of the security loop 12 which is integrally formed within the package by means of being printed on the inside face of panel 10. The security module in this embodiment is re-usable and is releasably attached to the back panel 8 of the package as described above. Optionally, the security module can operate as a stand or support for the package for display and storage purposes (thus obviating the need for hanging aperture 18). The security module can take a variety of sizes and/or shapes and is not limited to that illustrated. It must be designed suitably for connecting to the terminals 14, 16 of the security loop 12. Whether the circuit is printed on the front card or the rear card determines where the module needs to connect or contact the package. The module may be magnetically turned on or off or a key could be used, other means to turn the module off and on may be used as well. The security module can be attached in a number of ways to the package including: clip in, slide in, strapped onto the package, affixed by other mechanical means and/or adhered.

The circuit described is formed of standard known components. It will be understood that other configurations and arrangement and types of electrical components will be suitable for forming a security module for application of the present invention and the circuit of the security module could be formed on an integrated semiconductor chip. The important elements of the circuit are that in response to a break or interruption in the security loop 12 disposed within the package, the circuit is capable of causing an alert to be issued. This alert may be the illumination of a light such as an LED and/or the sounding of an alarm or buzzer. Additionally or alternatively, the alert may be the transmission of a signal, for example an RF (radio frequency) signal that is coupled to a receiver disposed elsewhere, within a store which could prompt a member of staff to take action. The transmitted signal could for example cause an alarm to sound in the security guard's office, or could cause a primary alarm in the store to sound rather than a small alarm contained within the security module itself. The aforedescribed alerts represent a few of many envisaged options which could be used in combination or separately depending upon the application of the invention.

The security module may be disarmed by a tool or other mechanism which can be used to open the switch 52. Once disarmed, the security module 70 can be removed from the package (by manipulating the tabs 60*a*, 60*b* and 58 out of engagement with the module 70, which can then be reused. An attempt to disconnect the security module 70 from the package (and hence security loop 12) before the security module 70 is switched off will cause the alert to be issued.

In FIGS. 5 and 6 a demonstration model of the first embodiment is shown. Many features are common to all embodiments and these features are denoted by the same reference numeral, albeit with the added prefix of '100' or '200' to illustrate that the features are of the second or third embodiment. Since many features are common to each of the described embodiments, only the differences are described in detail. The completed composite package is not illustrated, but the front 110 and back 108 components of the package are shown. In the second embodiment, the security loop 112 printed onto the front panel 110, includes a gap or missing section 200. The rear panel 108 is provided with a slot 190 in the vicinity of the missing section 200, and also auxiliary conductor portions 192. Once assembled, the front and back panels 110, 108 are overlaid such that the slot 190 is vertically aligned with the missing section 200, and at least the outward portions of auxiliary conductor portions 192 come into contact with security loop 112 near missing section 200. A key 196 is separately provided. The key includes an electrically conductive portion 198 that can complete the security loop 112 once the key 196 is fitted into the slot 190. For example, key 196 may have a conductive layer on at least one of its front or back surfaces, to bridge the gap 200 in security loop 112, or bridge the gap in auxiliary conductor portions 192, or both. The key may be made of a material thin enough to be slid between front panel 110 and back panel 108. The key may be a thin piece of metal, or a metal coating, foil, or film on a paperboard or plastic substrate. Providing conductors adjacent the gap 200 on both the front and back panels may provide a more reliable contact; however, it may be sufficient to provide the conductive gap on only one of the front or back panels. The key 196 may be provided with embossed portions 194 to assist in maintaining the key 196 within the slot. Slot 190 may be omitted in some instances, depending on the design of key 196, but slot 190 provides a convenient method for properly positioning the key. Alternately key 196 may be made with a key slot (not shown) to slide over the package outer surfaces, in which case slot 190 may extend across missing section 200 and/or auxiliary conductor portions 192, so that a conductive portion inside the key slot may make contact with and bridge missing section 200 and/or auxiliary conductor portions 192.

The purpose of the key 196 is that the demonstration model of the package can be assembled and the security loop 112 broken by removing the key 196 without destroying or damaging the package. Once it has been demonstrated how the integrally disposed security mechanism operates, the key 196 can easily be replaced (without having to interfere with the switch 52 of the security module) to stop the alert (i.e. to turn the LED and alarm off). Repeated demonstrations can then be made without having to damage a package each time and without having to switch the security module on and off.

In the third illustrated embodiment (see FIG. 7), the security loop 212 or conductive trace follows a path weaving around the package in an undulating manner such that the security loop covers a path around the aperture and around the edge 22. Only one distinct continuous loop is accommodated by the electronic circuit of the example described and therefore in embodiments utilizing this or a similar circuit, the security loop must be a single continuous loop that starts at the first contact 214 and terminates at the second contact 216. The benefit of such a serpent like undulating weaving path 212 is that the design protects the package from breaches close to the center (at the blister and article location) as well as from breaches initiated at the outside edge of the package.

Figure 8:
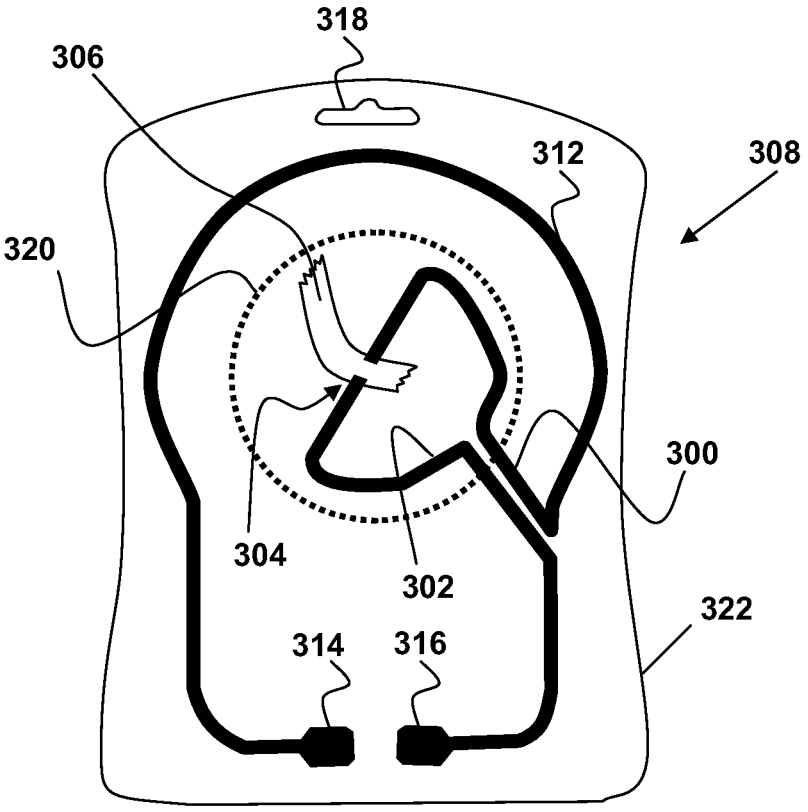
FIG. 8 shows a plan view of a package formed with a security loop for monitoring the presence of a product within the package.

A fourth embodiment is illustrated in FIG. 8 where there is shown a second part blank 308 (or back panel 308) for forming a package having an at least partially integral security mechanism. The blank 308 is defined by an edge 322 and a security loop 312. A hanging aperture 318 may also be provided for facilitating hanging display or hanging storage of the package. Aperture 320 is an optional feature that may not be present when the invention is applied to other formats of package not including a blister. The security loop 312 may be formed of conductive ink that is printed onto the paperboard panel 308.

The security loop 312 is printed such that it at least partially surrounds the area 320 corresponding to the blister that may be disposed on the front panel (not shown). The specific path or shape of the security loop may vary according to considerations such as the nature of the package to which the invention is applied; the configuration (i.e. shape) of article(s) held by the package and the number and orientation of articles contained within the package. The security loop 312 may be arranged such that to gain access to an article held within the package, interruption or complete breaking of the security loop 312 is necessary or at least highly likely. The security loop 312 may be coupled for example via contacts 314, 316 (or other means) to an external security module (see FIG. 4) that includes electronic circuitry (see FIG. 3) configured such that a detected interruption in the security loop 312 will cause an alert to be issued.

In the embodiment of FIG. 8, the security loop 312 or conductive trace follows a path around the periphery of the package. The path of the security loop may be relatively smooth as for security loop 312, or may be a serpentine or undulating as for security loop 212 previously shown. Additionally, the security loop may contain one or more portions such as branch 300 that communicate with the area 320 under the blister. Within this area there may be provided auxiliary conductive pathways 302 passing under or proximate to at least portions of the product that is contained within the blister. Within the auxiliary pathways may be provided a gap 304 whose purpose will now be described.

In order to complete the circuit of the security loop, the gap 304 may be bridged by a conductive material, for example, a conductive tape 306 placed on or across the gap 304. Tape 306 may be attached perpendicular to the loop as shown, or along the loop, or at an angle to the loop, as long as gap 304 is bridged by the tape. The tape 306 is also attached to the product contained within the package, either at the opposite end of the tape, or anywhere else along the tape, especially if a two-sided adhesive conductive tape is used. The attachment of tape 306 to the product should be stronger than the attachment of tape 306 to gap 304, so that if the product is taken from the package, tape 306 will be pulled off gap 304, causing an alert to be issued. In this manner, if a thief cuts into the blister to remove the product, an alert may be issued, even if the blister itself was not protected by the security loop (e.g. by printing or stamping a portion of the security loop onto the blister).

Instead of a conductive tape strip being used as depicted by tape 306, the conductive tape may take the form of a patch such as a square or round patch that is adhered to gap 304, and to which patch the product may also be adhered, such that removing the product will lift the patch off gap 304 and sound an alert.

The tape 306 may be conductive over its entirety, or may be conductive only in the vicinity of gap 304. While the embodiment shown in FIG. 8 uses a conductive tape 306 to bridge gap 304, protection may also be provided by using a non-conductive tape, which is attached to the product and adhered to a portion of an uninterrupted auxiliary conductive pathway 302, so that removal of the product causes the tape to pull away from the auxiliary conductive pathway 302, in the process causing a break to occur in the auxiliary conductive pathway 302. In such an embodiment, it may be possible to omit gap 304, since a break will be caused in the conductive pathway 302 by pulling away a portion of that pathway, rather than by pulling away a bridge across a gap in the pathway.

Ideally any tape 306 will be attached to or adhere strongly to the product, yet be capable of being removed from the product without excessive effort after purchase, either by peeling, scraping, untying, or otherwise removing tape 306 from the product. If the product is connected to the conductive pathway 302 by tape 306, or string, wire, glue or other means, the product may advantageously be close to the conductive pathway so that the tape, wire, string, glue or other means itself cannot be cut which could allow the product to be removed without raising an alarm.

Figure 9:
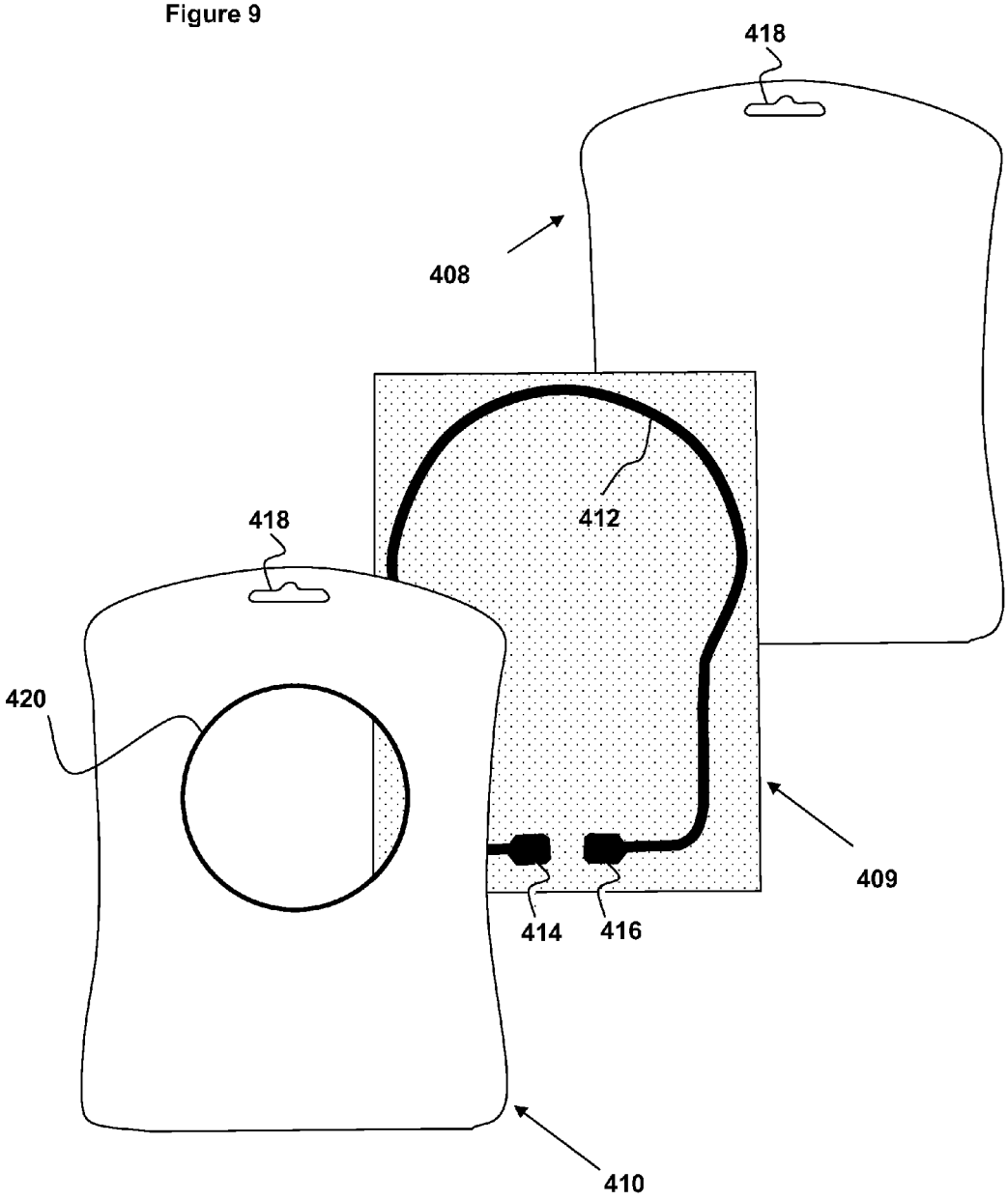
FIG. 9 shows a plan view of a package formed with a security loop in an additional layer.

A fifth embodiment is illustrated in FIG. 9 where there is shown a first part blank 410 (e.g. a front panel), a second part blank 408 (or back panel), and a third part 409 (or intermediate panel) for forming a package having an at least partially integral security mechanism. The intermediate panel 409 may be sandwiched between blanks 410 and 408. The intermediate panel includes a security loop 412 that may be formed of conductive ink that is printed onto the intermediate panel 409. Intermediate panel 409 may be chosen of materials that impart desirable properties to the package. For example, it may be easier or more economical to form conductive traces such as security loop 412 on a polymer or plastic film, thus intermediate panel 409 may be formed of a polymer or plastic film. Such a film may be more flexible that another substrate such as paperboard, and if folded may be less susceptible to cracking than paperboard. In some cases a polymer or plastic substrate may provide a security loop with more reliable electrical properties. Forming the security loop on an intermediate panel may also allow more options in assembling the package, since the outer panels may be chosen for strength, superior graphics, etc, which the intermediate panel may be chosen as a better support for circuitry such as the security loop.

The security loop 412 is printed or otherwise formed such that it at least partially surrounds the area 420 corresponding to the blister that may be disposed on the front panel 410. As in the other embodiments, the specific path or shape of the security loop may vary according to considerations such as the nature of the package to which the invention is applied; the configuration (i.e. shape) of article(s) held by the package and the number and orientation of articles contained within the package. The security loop 412 may be coupled for example via contacts 414, 416 (or other means) to an external security module (see FIG. 4) that includes electronic circuitry (see FIG. 3) configured such that a detected interruption in the security loop 412 will cause an alert to be issued. The security loop 412 may be formed on one or both surfaces of intermediate panel 409. For example with a security module positioned in or on back panel 408, the security loop 412 may be formed on the rear face of intermediate panel 409. Features such as a hanging aperture 418 may be used with the package.

Figure 10:
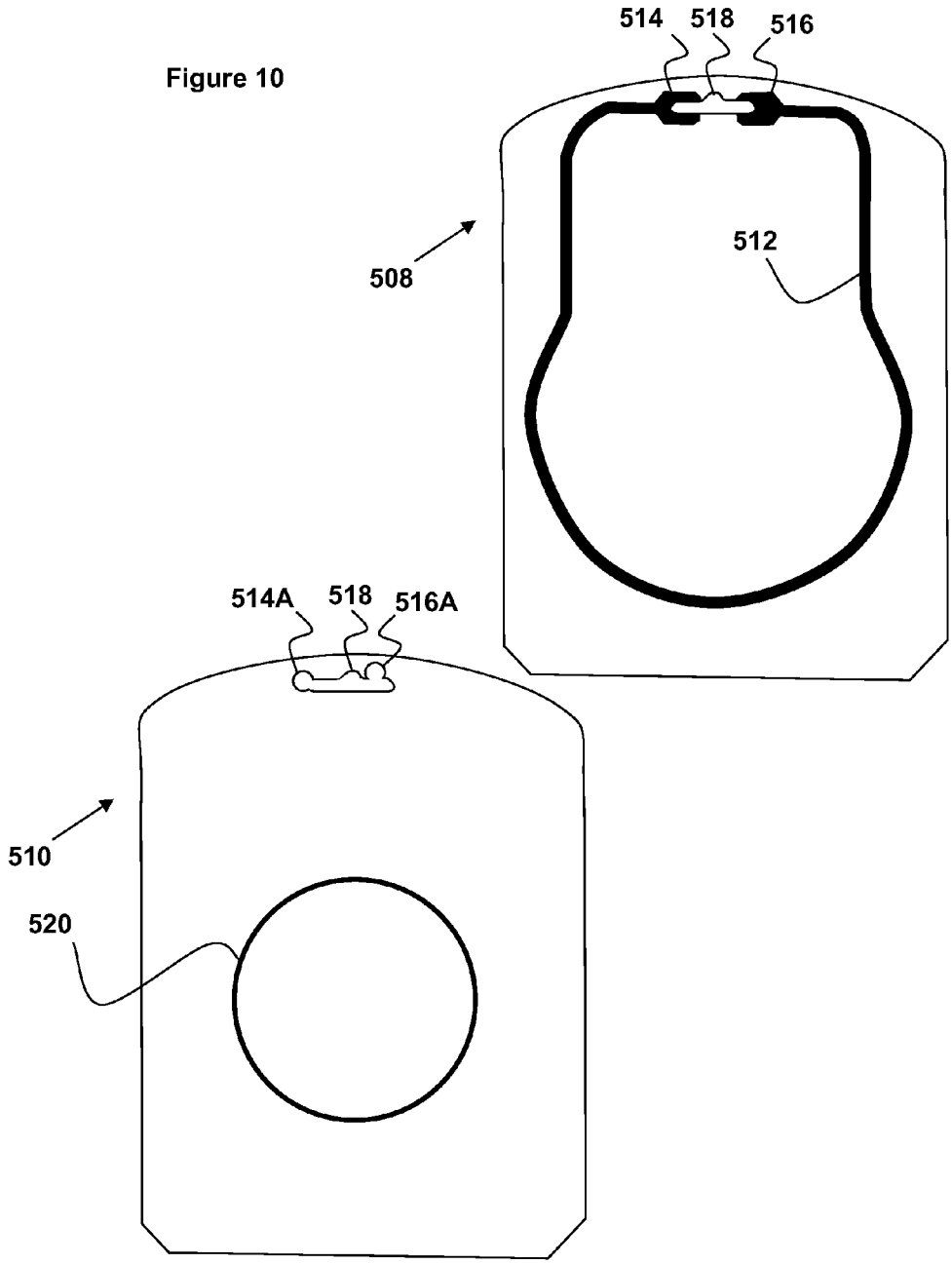
FIG. 10 shows a plan view of parts of a package with the security loop terminated at a different location.

A sixth embodiment is illustrated in FIG. 10 where there is shown a first part blank 510 (e.g. a front panel), and a second part blank 508 (or back panel) for forming a package having an at least partially integral security mechanism. One of the panels (here, back panel 508) includes a security loop 512 that may be formed of conductive ink that is printed onto the panel. Alternately the security loop 512 may be formed on front panel 510, or on an intermediate panel as in FIG. 9. The security loop 512 is printed or otherwise formed such that it at least partially surrounds the area 520 corresponding to the blister that may protrude through the front panel 510. As in the other embodiments, the specific path or shape of the security loop may vary according to considerations such as the nature of the package to which the invention is applied; the configuration (i.e. shape) of article(s) held by the package and the number and orientation of articles contained within the package. The security loop 512 may be coupled for example via contacts 514, 516 (or other means) to an external security module (see FIG. 4) that includes electronic circuitry (see FIG. 3) configured such that a detected interruption in the security loop 512 will cause an alert to be issued. Here the contacts 514, 516 may be located adjacent hanging aperture 518 so that the external security module may be attached in the vicinity of the hanging aperture 518. In one example, the external security module may be fastened through the hanging aperture 518, for example by one or more pins. The external security module may make contact with contacts 514, 516 through such pins, or by other connection means such as prongs, teeth, capacitative, inductive, or conductive contacts, or other circuitry. In one embodiment, contact holes 514A, 516A may be provided in the front panel for example if the security loop is formed on the rear panel or on an intermediate panel. The locations of the contact holes shown in FIG. 10 are examples only. In another embodiment contact holes 514A, 516A may be formed in the rear panel if the security loop is formed on the front panel or on an intermediate panel. The external security module may include a hang hole or loop by which to be suspected from a display rack. By having contact holes 514A, 516A superimposed upon contacts 514, 516 a good electrical contact may be obtained, including optionally a clamping force or a conductive adhesive to help maintain good electrical contact.

Figure 11:
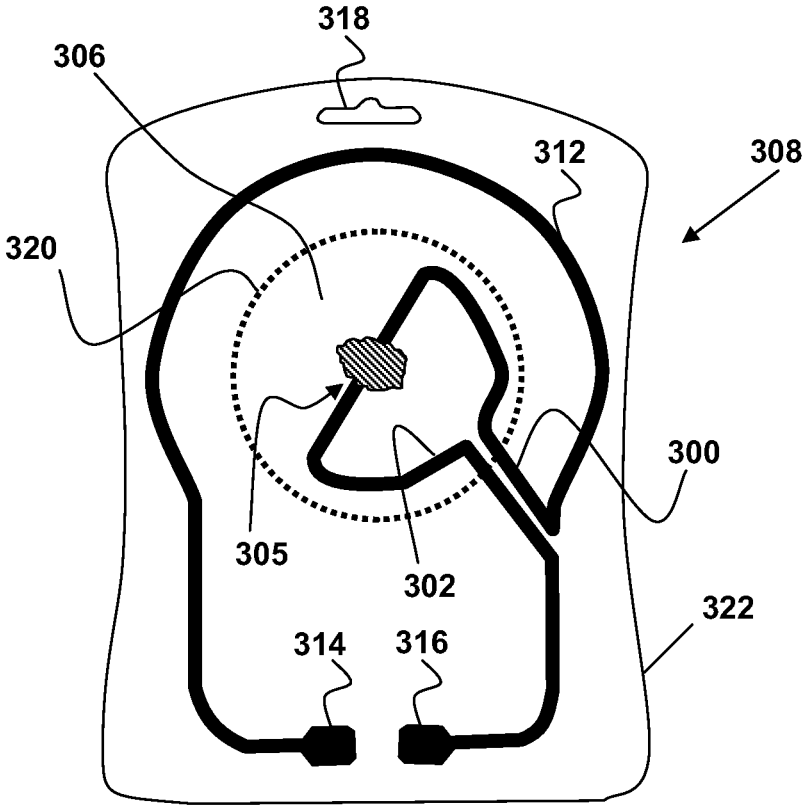
FIG. 11 shows a plan view of a package formed with a security loop for monitoring the presence of a product within the package.

A seventh embodiment is illustrated in FIG. 11, which is somewhat like FIG. 8 and has certain parts already described above. The security loop 312 may be formed of conductive ink that is printed onto the paperboard panel 308.

The security loop 312 may be printed such that it at least partially surrounds the area 320 corresponding to the blister that may be disposed on the front panel (not shown). The specific path or shape of the security loop may vary according to considerations such as the nature of the package to which the invention is applied; the configuration (i.e. shape) of article(s) held by the package and the number and orientation of articles contained within the package. The security loop 312 may be arranged such that to gain access to an article held within the package, interruption or complete breaking of the security loop 312 is necessary or at least highly likely. The security loop 312 may be coupled for example via contacts 314, 316 (or other means) to an external security module (see FIG. 4) that includes electronic circuitry (see FIG. 3) configured such that a detected interruption in the security loop 312 will cause an alert to be issued.

In the embodiment of FIG. 11, the security loop 312 or conductive trace follows a path around the periphery of the package. The path of the security loop may be relatively smooth as for security loop 312, or may be a serpentine or undulating as for security loop 212 previously shown. Additionally, the security loop may contain one or more portions such as branch 300 that communicate with the area 320 under the blister. Within this area there may be provided auxiliary conductive pathways 302 passing under or proximate to at least portions of the product that is contained within the blister. A securing material 305 such as an adhesive, for example a glue dot or blob, may be placed upon the conductive pathway to attach thereto an article contained within the package. The securing material may be chosen so that it is difficult or impossible to remove the article from the package without tearing or breaking conductive pathway 302.

Thus if the product article is taken from the package, securing material 305 will be pulled away from conductive pathway 302, tearing the pathway, and causing an alert to be issued. In this manner, if a thief cuts into the blister to remove the product, an alert may be issued, even if the blister itself was not protected by the security loop (e.g. by printing or stamping a portion of the security loop onto the blister). Since the product article cannot be removed from the package without raising an alarm, it may not be necessary for a conductive pathway to surround the area 320.

Ideally any securing material 305 will be attached to or adhere strongly to the product, yet be capable of being removed from the product without excessive effort after purchase, either by peeling, scraping, dissolving, or otherwise removing securing material 305 from the product. If the product is connected to the conductive pathway 302 by securing material 305, the product may advantageously be close to the conductive pathway so that the a knife cannot be inserted between the product and the package to cut through the securing material without breaking the conductive pathway.

Figure 12:
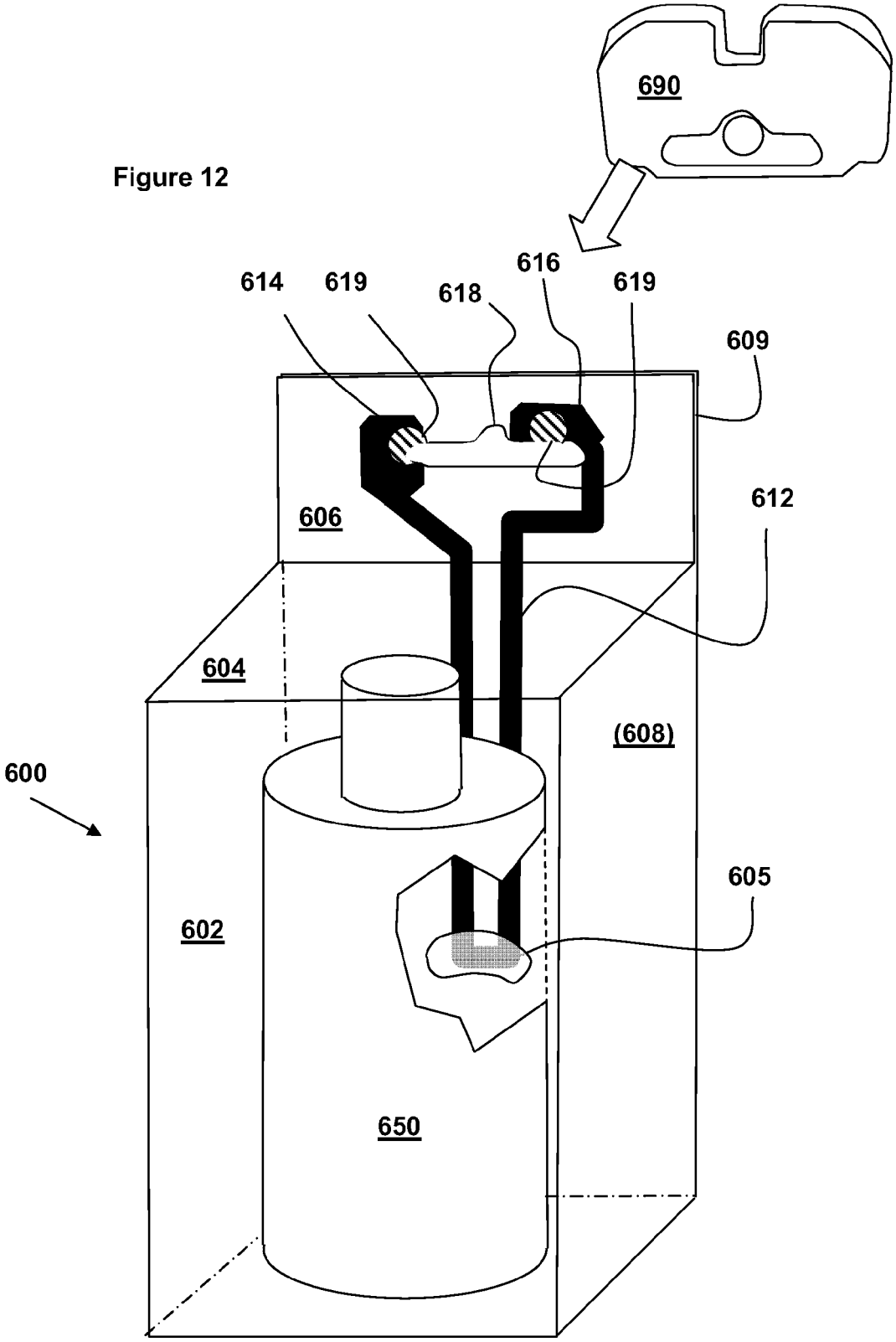
FIG. 12 shows a perspective view of another package with a security loop for monitoring the presence of a product within the package.

An eighth embodiment is shown in FIG. 12. Folding carton 600 is shown with a conductive trace 612 on a back panel 608 which has a hang hole 618. The hang hole provides a place to attach an electronic surveillance module 690, and a location to which to run conductive trace 612. The trace could be a label with conductive ink printed on it or a laminated aluminum foil/paper substrate with the trace die-cut in a specific pattern. The traces connect the module to the product.

This package of FIG. 12 does not require traces to be printed around the perimeter of the package. It allows the use of a windowing package machine to make the product. The trace could be placed in the box just like the transparency material used with a window.

Package 600 may be a container such as a paperboard carton holding a product item 650 such as a bottle. In a manner somewhat similar to that described for FIG. 11, the product 650 may be attached to a portion of conductive pathway 612 by a securing means 605. Securing means 605 may be a securing material, such as a glue dot or blob. A fugitive glue may be used. The product 650 may advantageously be positioned closely to the package wall that supports the conductive pathway 612, making securing material 605 relatively inaccessible to a thief so that it is difficult or impossible to cut through the securing material 605.

Package 600 may include a back panel 608 supporting conductive pathway 612. The package may include other panels, for example front panel 602 and top panel 604. The conductive pathway may extend upward from back panel 608 onto back panel extension 609 on which the conductive pathway may terminate in a pair of contacts 614, 616. These contacts may be located adjacent or partly contiguous with hang hole 618. The package shown in FIG. 12 advantageously may remove the need for conductive pathway 612 to cross any fold lines. If the back panel extension 609 is covered in front by top panel extension 606 (or another panel), one or more contact access cutouts 619 may be provided in top panel extension 606 (or the other panel or panels) to provide contact access for security module 690 as described previously.

A variation of the package 600 shown in FIG. 12 would be to include a gap in the conductive pathway (as in FIG. 8) and bridge the gap with a conductive path (such as a ribbon, wire or tape; not shown) wrapped around the product item 650 so that removing the product item from the package would break the wrapped conductor or break its connection with the conductive pathway upon the back panel 608, thereby raising an alarm. Another variation would be to wrap or otherwise attach a ribbon, wire, tape, piece of paper or paperboard (not shown) or other suitable structure (conductive or non-conductive) to the product item or around the product item, and attach a portion of this ribbon, wire, tape, piece of paper or paperboard, or other suitable structure to the conductive pathway upon back panel 608, so that removing the product item would cause the conductive pathway to be torn or otherwise broken or disrupted, thereby raising an alarm.

Since the security system shown in FIG. 12 will detect product 650 being removed from package 600, it may not be necessary to run conductive pathways around multiple panels of the package. The package may have one or more transparent or open windows to allow the customer to view or touch the product 650. Since the securing means 605 will break the conductive pathway 612 if the product is removed, the package 600 may be relatively open and may have fewer panels than shown in FIG. 12

It will be recognized that various features of different embodiments as described herein may be utilized in combination with each other.

Although the examples shown in the Figures incorporate a single security loop, it should be understood that more than one security loop may be used. For example, the single security loop shown in FIG. 8 may be replaced by a first security loop around the perimeter of a blister, and a second security loop underlying the blister area and optionally containing a gap to be broken if the contents are removed. The first and second security loops may each have their own contacts to connect to an external security module. The security module in turn may have one pair of contacts for the first security loop and another pair of contacts for the second security loop. Portions of the circuitry within the security module, such as the resistance-measuring circuitry, may be duplicated to serve the second security loop. Some portions of the circuitry within the security module may be shared between both loops, for example the battery, switch, and audible alarm.

Multiple security loops may be utilized in other embodiments. For example, a package in the form of a box may have six faces (e.g. top, bottom, and four sides), and the six faces may each have a security loop, or multiple security loops may be used with some faces sharing a security loop. Multiple security loops may be used when a single security loop would have too high a resistance, or would be large enough to have other undesirable attributes, such as acting as an antenna.

Instead of having multiple pairs of contacts for the security loops (and the security module) the security loops may share common contacts to be connected to one pair or a few pairs of contacts on the security module, with the security module circuitry adjusted to detect differences in resistances which occur when one or more of the security loops are breached. When two or more security loops share a pair of common contacts, their combined resistances may therefore be reduced below the individual resistance of any individual loop among the two or more security loops. This may result in a combined resistance that is more readily measured by the security module.

Optionally, the security module may cover or obscure an easy-open feature such as a nick, tear, or cut in the package, by which the package can be opened after removal of the security module. For example, the package may be formed with a notch or cut in one or more of the panels, and the security module when installed may cover or otherwise obscure the notch or cut, and prevent access thereto. Once the security module has been removed, the package may readily be opened using the easy-open feature. The notch or cut may be provided in the package during its fabrication, then covered by the security module. Alternately, the security module may create the tear in the package when the security module is installed.

It can be appreciated that various changes may be made within the scope of the present invention, for example, the size and shape of the panels and aperture may be adjusted to accommodate blisters and articles of differing size or shape. In other embodiments of the invention it is envisaged that the package will include more than two panels and/or that the articles themselves may not be on direct display through a blister or similar transparent material, but rather fully contained and enclosed within the package. The security loop may be printed onto a number of panels of the carton blank, which when folded and glued to form a complete carton are aligned so that a continuous security loop is formed and opening of the carton will cause an interruption or complete breaking of the security loop.

It is envisaged that in other embodiments of the invention more than one electronic circuit of the type described above is accommodated within a single module and/or that a single electronic circuit capable of detecting interruptions in more than one security loop is accommodated within a single module. In such embodiments, more than one continuous security loop is incorporated within the package for protecting the articles within that package. This is useful where more than one article is contained within a single package. It is to be understood that the loop may printed on the internal side of the package thereby not interfering with the external graphics of the package. If so desired based on manufacturing preferences, the loop could be printed on the external side of the packaging materials. It is to be understood that this positioning may result in more accidental alarms from the ink being scraped off of the package.

To safeguard against the front panel 10 being separated from the back panel 8 to remove the article without the security loop being interrupted, the first part and second part panels 10, 8 can be either be adhered using very strong adhesive, or alternatively, part of the security loop 12 can be printed on the inside face of each panel, so that neither panel includes the entire loop 12. When the panels 10, 8 are mated together, the security loop 12 is completed, and then if the package is tampered with by separating the front 10 and back 8 panels, the security loop will be broken and an alert will be issued.

By the term "interruption" it is meant any perturbation of the package that affects the resistance of the security loop 12. Indeed, it may not be necessary to completely break the security loop 12, nor even partially tear the security loop 12, the circuitry can be sensitive enough to detect a tear within the material of the package even if that cut does not directly sever the circuit loop, albeit with some limitation on the size of cut that can be detected. The module's sensitivity to changes in resistance may be adjusted based on manufacturing preferences.

There are various advantages to the disclosed security package such as using the conductive ink to surround the package and prevent access to the interior of the package reduces the number of steps the retailer has to perform to place and activate the security device onto a package, which saves in labor time as well as reduces the possible errors that could occur. Using the conductive ink also reduces the interruption to the external graphics of a package allowing products to more effectively use this space for advertising.

It will be recognized that as used herein, directional references such as "top," "bottom," "front," "back," "end," "side," "inner," "outer," "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention.

It will be recognized that where lists of examples have been given in the above description, these exemplary lists are non-exhaustive and represent only some suitable options for variations of the invention and should not, in anyway, be construed as constituting an exhaustive, finite limitation of the invention's application.

The invention claimed is:

1. A package containing a primary article and having an electrically conductive loop incorporated therein, the electrically conductive loop being connectable to a second part of a security feature such that together, the electrically conductive loop and second part of the security feature are capable of detecting when the package is opened and capable of issuing an electrical signal in response to that detected opening which electrical signal is operable to cause an alert to be issued, wherein the second part of the security feature is a separate module external to the package that is connectable to and removable from the package, wherein the electrically conductive loop comprises two terminals, wherein at least a portion of said package comprises a first layer of material and a second layer of material, wherein at least a first one of the terminals is supported on the first layer, and the second layer comprises at least one opening superimposed over at least a portion of the first one of the terminals.

2. A package according to claim 1 wherein the alert is an audible alarm emitted directly by the security feature.

3. A package according to claim 1 wherein the electrically conductive loop is incorporated within the package and disposed relative to the article such that removal of the article from the package is likely to cause interruption of said electrically conductive loop, said electrically conductive loop being connectable to the second part of the security feature for detecting an interruption in said security loop and operable to react to such a detected interruption by issuing an alert.

4. A package according to claim 3 wherein the electrically conductive loop is formed as an integral part of the package and each of the two terminals is connectable to the second part of the security feature and said second part of the security feature is operable to issue an alert by sounding an alarm and/or by illuminating a light and/or by transmitting an electromagnetic signal.

5. A package according to claim 3 wherein the electrically conductive loop is formed from conductive printed ink, conductive ribbon, conductive foil and/or conductive wire.

6. A package according to claim 1 wherein the second part of the security feature detects opening of the package by detecting a change in resistance of the electrically conductive loop.

7. A package according to claim 6 wherein the change in resistance is an increase in resistance and is due to one or more of the following: an interruption in the package integrity, an interruption in the electrically conductive loop or the breaking of the electrically conductive loop.

8. A security module for use in a package according to claim 1 wherein the security module comprises the second part of the security feature and the electrically conductive loop is disposed within the package.

9. A security module according to claim 8 wherein the electrically conductive loop is incorporated within the package and the second part of the security feature is capable of detecting an interruption in said electrically conductive loop and capable of reacting to such a detected interruption by issuing an alert.

10. A package according to claim 1 further comprising a security module wherein the security module comprises the second part of the security feature and the electrically conductive loop is disposed within the package.

11. A blank for forming a package, the blank comprising an integrally formed electrically conductive loop having terminals for coupling to a security module after said blank is formed into a carton or package, said security module to be external to the carton or package and removably connected to the carton or package, wherein the blank comprises at least a first panel and a second panel arranged to be joined together in facing relationship in the finished package, with at least a first one of the terminals in the finished package supported on the first panel and facing the second panel, and with at least one opening in the second panel superimposed over at least a portion of the first one of the terminals.

12. A kit of parts for forming a package having an integral electrically conductive loop, the kit of parts comprising one or more blanks for forming the package, at least one of said blanks having an electrically conductive loop incorporated therein; wherein the one or more blanks comprise at least a first panel and a second panel arranged to be joined together in facing relationship in the finished package, with at least a first one of the terminals in the finished package supported on the first panel and facing the second panel, and with at least one opening in the second panel superimposed over at least a portion of the first one of the terminals;

one or more articles to be contained in the package; and a second part of the security feature external to the package and removably connected thereto, the second part of the security feature comprising an electronic circuit capable of connecting to the electrically conductive loop and capable of detecting a breach of the package integrity and in response to that detected breach issues an electrical signal, which electrical signal causes an alert to be issued.

13. A package according to claim 4, further comprising one or more additional electrically conductive loops, wherein each of the loops comprises its own pair of terminals, and each pair of terminals is separately connected to the security module.

14. A package according to claim 4, further comprising one or more additional electrically conductive loops, wherein at least two of the loops share a common pair of terminals and said common pair of terminals is connected to the security module.

15. A package according to claim 4, comprising an aperture through both layers of material, wherein the two terminals are located in close proximity to the aperture.

16. A package according to claim 15, wherein the aperture is a hang hole.

17. The package of claim 1, wherein the first and second layer of material are joined together in facing relationship with the electrically conductive loop positioned between the layers.

18. The package of claim 1, wherein the separate module is connectable to the package, and reconnectable to the package, by pins, prongs, teeth, capacitative contact, inductive contact, or conductive contact.

* * * * *